US005812041A

United States Patent [19]

Ishikawa et al.

[11] Patent Number: 5,812,041

[45] Date of Patent: Sep. 22, 1998

[54] TERMINAL HOUSING MOUNTING STRUCTURE FOR ELECTROMAGNETIC SWITCH

[75] Inventors: Katsuhiko Ishikawa; Hitoshi Ono, both of Kiryu, Japan

[73] Assignee: Mitsuba Electric Manufacturing Co., Ltd., Kiryu, Japan

[21] Appl. No.: 702,187

[22] Filed: Aug. 23, 1996

[30] Foreign Application Priority Data

Aug. 30, 1995 [JP] Japan ..... 7-245356

[51] Int. Cl.[6] ..... H01H 67/02; H01H 1/00; H01F 27/29; H01R 13/40

[52] U.S. Cl. ..... 335/126; 335/126; 335/125; 335/131; 336/192; 439/595; 200/284

[58] Field of Search ..... 335/125, 126, 335/131; 336/192; 439/595; 200/284

[56] References Cited

U.S. PATENT DOCUMENTS 4,725,801 2/1988 Snyder ..... 335/125

FOREIGN PATENT DOCUMENTS 4-46327 4/1992 Japan .

*Primary Examiner*—Michael L. Gellner
*Assistant Examiner*—Tuyen T. Nguyen
*Attorney, Agent, or Firm*—Oliff & Berridge, PLC

[57] ABSTRACT

A terminal housing mounting structure adapted for use with an electromagnetic switch includes a terminal housing mounted to a switch cover, and a terminal bolt that passes through the terminal housing and the switch cover. The terminal housing has an alignment groove that receives a lug plate in a predetermined orientation. A cylindrical end portion of the switch cover and a cylindrical end portion of the terminal housing are provided with engagable sawteeth equally spaced apart from one another so that the terminal housing is angularly displaceable and releaseably engagable with respect to the switch cover in a plurality of angular increments.

12 Claims, 10 Drawing Sheets

TERMINAL HOUSING MOUNTING STRUCTURE FOR ELECTROMAGNETIC SWITCH

BACKGROUND OF THE INVENTION

1. Field of the Invention

The present invention relates to a terminal housing mounting structure for an electromagnetic switch for use as a starter switch in motor vehicles such as cars and motorcycles.

2. Description of the Related Art

An electromagnetic switch used as a starter switch is designed to perform a switching action. During the switching action, coils are activated when an ignition switch is turned on and movable contact points of a switch plunger are moved into a bridging configuration. In the bridging configuration, a battery side terminal bolt and a motor side terminal bolt contact the movable contact points of the plunger facing the terminal bolts.

In this arrangement, the motor side terminal bolt is mounted on a switch cover disposed at one end of the plunger in a manner that the threaded portion of the motor side terminal bolt projects from the switch cover and a conductor cable in its connected state is attached to the projected threaded portion of the motor side terminal bolt. As for the battery side terminal bolt, as shown in FIG. 10, a terminal housing 18 is attached to the threaded portion of the battery side terminal bolt 9 of a switch cover 17 and a nut 15 is tightened against washers 13, 14 fitted around the terminal bolt 9 in the terminal housing 18 to secure the terminal housing 18 to the switch cover 17. A lug plate 12*a* attached to the end of the conductor cable 12 which is connected to the battery is inserted into an alignment groove 18*a* formed on the end face of the terminal housing 18. A nut 16 is then tightened onto the lug plate 12*a*. Thus, the lug plate 12*a* is secured in its connected state.

In this known example, the terminal housing 18 has on its bottom end an alignment projection 18*b*, and the switch cover 17 has on its end face a notch 17*a* that is engaged with the alignment projection 18*b*. The terminal housing 18 is thus connected to the switch cover 17 in a manner that aligns the terminal housing 18 with the switch cover 17 when they are in a connected state.

In the above arrangement, the lug plate 12*a* can be oriented with respect to the terminal housing 18 in only one direction when aligned and, thus, the terminal housing 18 is dedicated to only one model or a limited number of models of vehicles.

There is today a growing demand for multi-model components rather than model-specific components. It is desirable for an electromagnetic switch to be useful in many models of vehicles. In the above known component, the orientation of the projection of the lug plate 12*a* is one direction only. To make the electromagnetic switch adaptable to multiple models, a particular terminal housing dedicated to each model must be manufactured or the conductor cable 12 connected to the lug plate 12*a* must be routed in different directions from model to model. In the former case, the number of types of terminal housings is increased and, thus, inventory management of components becomes problematic. In the latter case, the conductor cable needs to be routed in an awkward fashion.

SUMMARY OF THE INVENTION

Accordingly, it is an object of the present invention to provide a terminal housing mounting structure for an electromagnetic switch free from the above-described problems.

The electromagnetic switch of the present invention comprises a switch cover and a cylindrical terminal housing that is mounted to the switch cover in a manner that the bottom surface of the terminal housing is in contact with the switch cover. A terminal bolt passes through the switch cover and extends into the terminal housing. A lug plate is mounted to the terminal housing for connecting the terminal bolt to a conductor cable for external connection. The terminal housing has an alignment groove on the top surface that engages with and supports the lug plate. The mating ends of the terminal housing and the switch cover have projecting teeth disposed circumferentially and equiangularly about their respective mating ends so that both mating toothed ends are engageable with each other. The orientation of the alignment groove with respect to the switch cover is thus rotatably and incrementally displaceable. In this arrangement, the terminal housing is rotatably displaceable with respect to the switch cover in increments equal to the number of engageable teeth on respective mating ends of the terminal housing and the switch cover. The projection orientation of the lug plate from the terminal housing is thus freely set, thereby allowing the electromagnetic switch to be adaptable to many models of vehicles as a multi-model component.

BRIEF DESCRIPTION OF THE DRAWINGS

A description of preferred embodiments will be given in conjunction with the following drawing figures, wherein like reference numbers refer to like elements, and wherein.

DESCRIPTION OF THE PREFERRED EMBODIMENT

Figure 1:
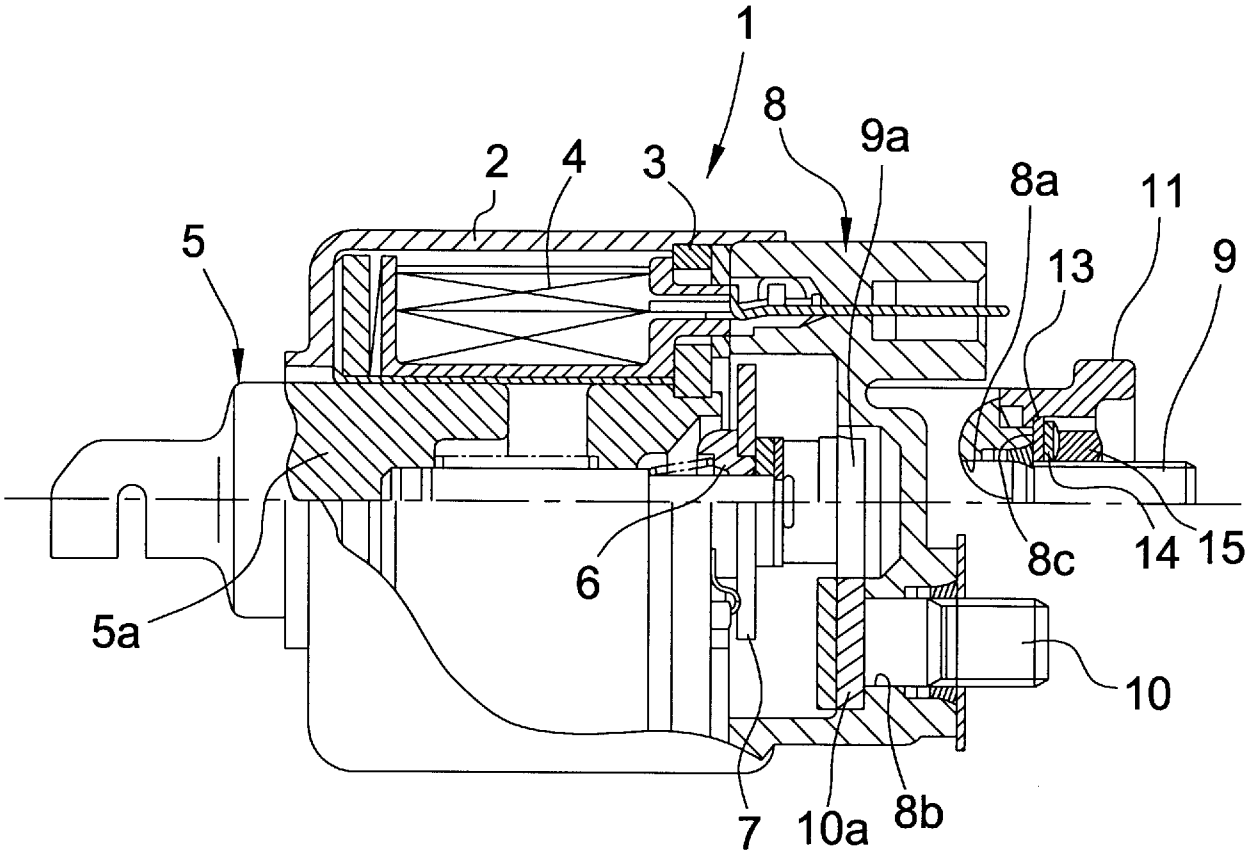
FIG. 1 is a side elevation view of an electromagnetic switch in partial cross-section taken generally along line 20—20 in FIG. 2, shows a terminal housing mounting structure embodying the present invention.
Figure 2:
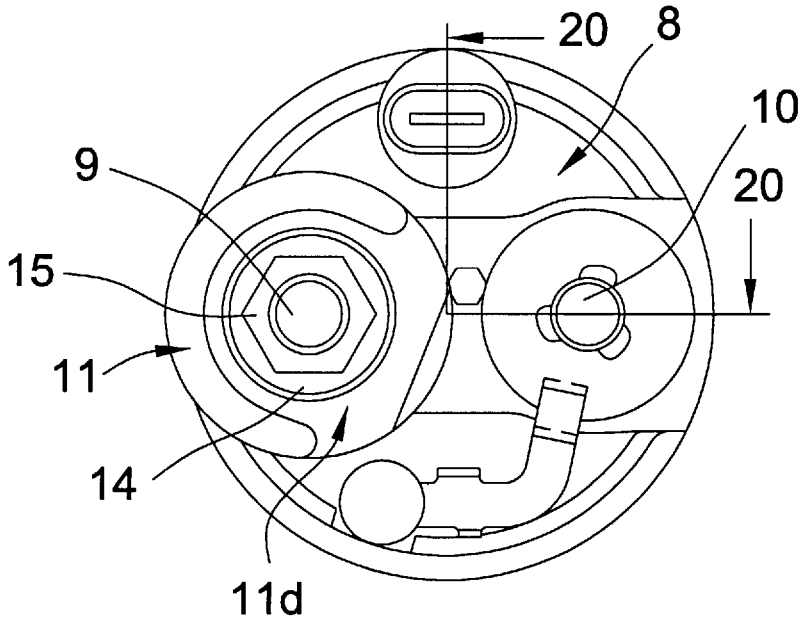
FIG. 2 is a top plan view showing the terminal housing mounting structure assembled onto the electromagnetic switch.
Figure 3:
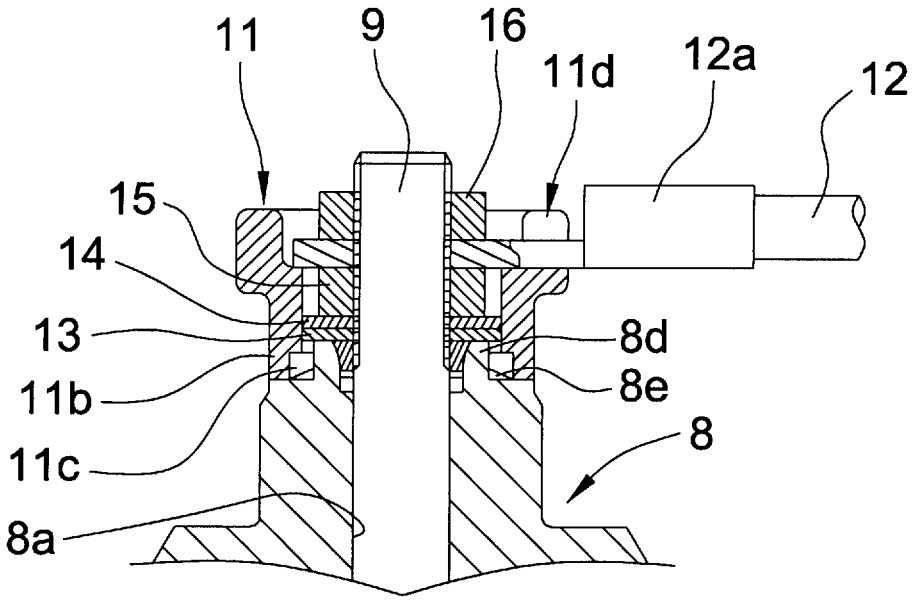
FIG. 3 is a side elevation view in cross-section of portion of the terminal housing mounting structure.
Figure 4:
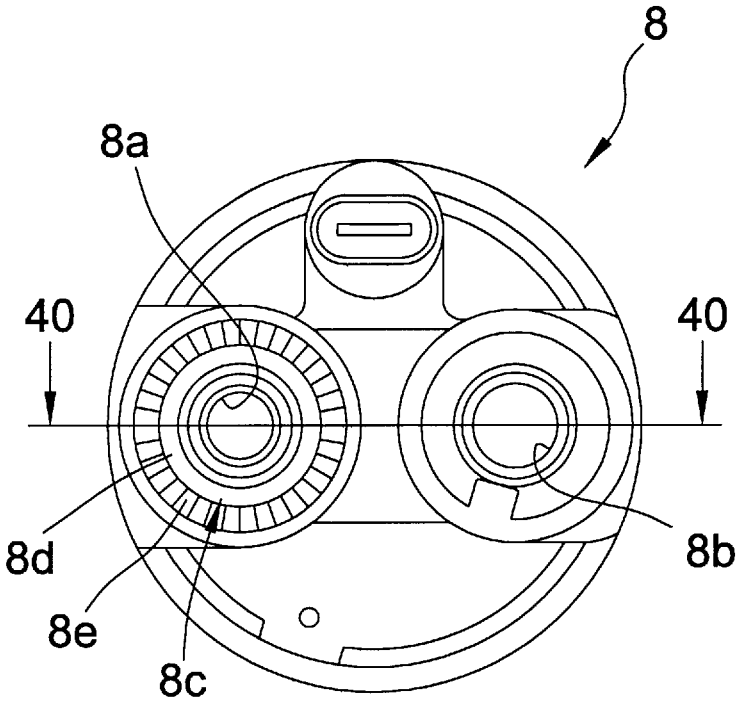
FIG. 4 is a top plan view of a switch cover of a terminal housing mounting structure embodying the present invention.
Figure 5:
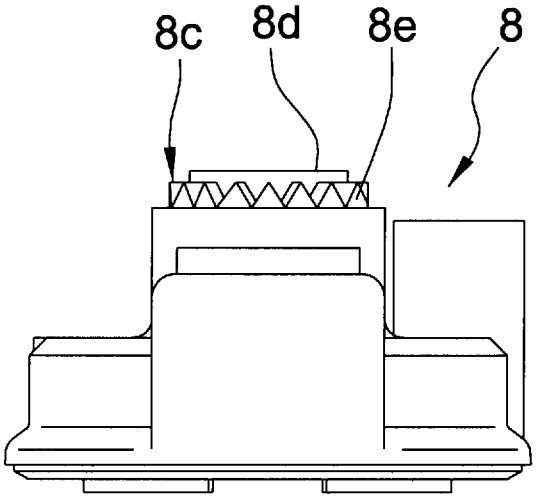
FIG. 5 is a side elevation view of the switch cover of FIG. 4.
Figure 6:
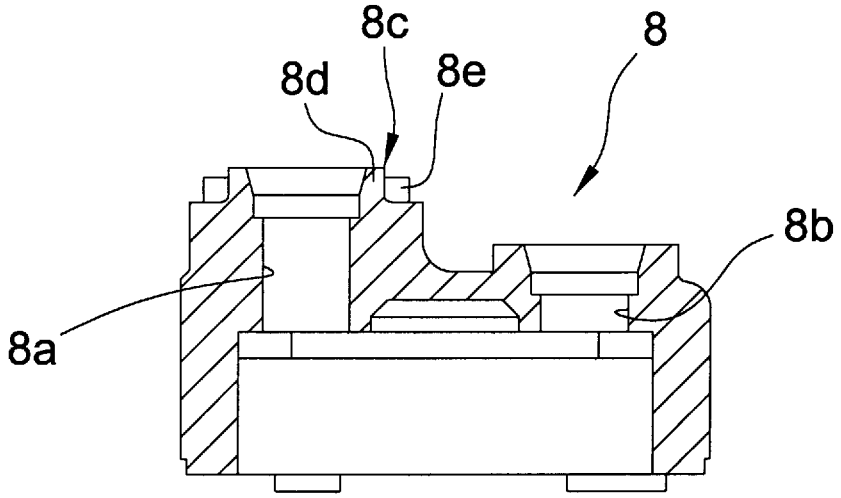
FIG. 6 is a side elevation view in cross-section of the switch cover taken along a line 40—40 in FIG. 4.
Figure 7:
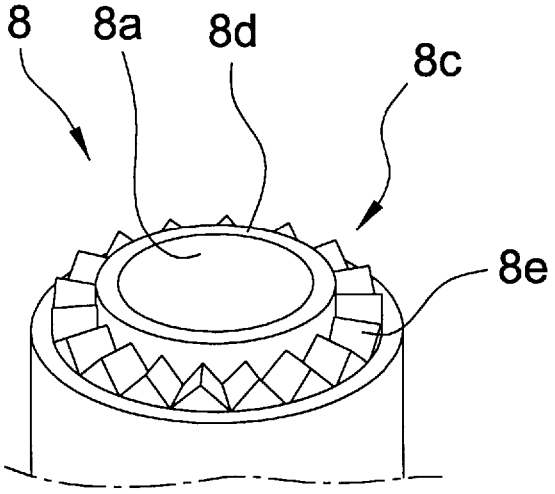
FIG. 7 is a perspective view showing a top portion of the switch cover.
Figure 8:
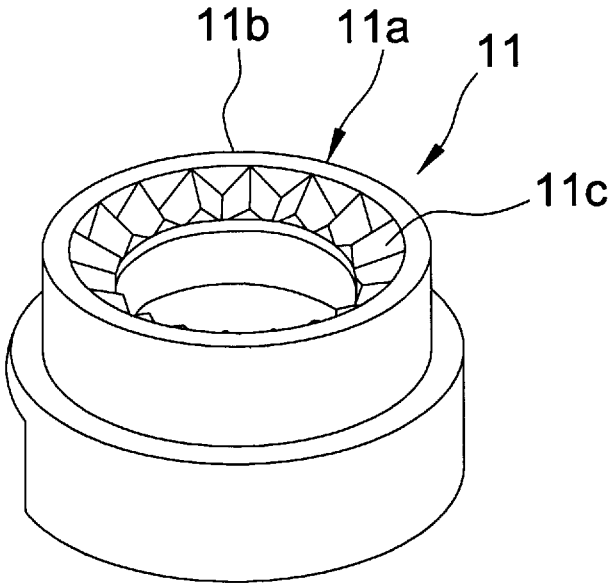
FIG. 8 is a perspective view showing a top portion the terminal housing of a terminal housing mounting structure embodying the present invention.
Figure 9A:
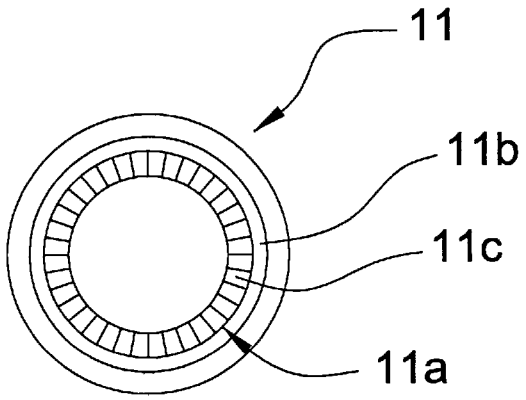
FIGS. 9A, 9B and 9C are a bottom view, cross-sectional view and front view of the terminal housing, respectively.
Figure 9B:
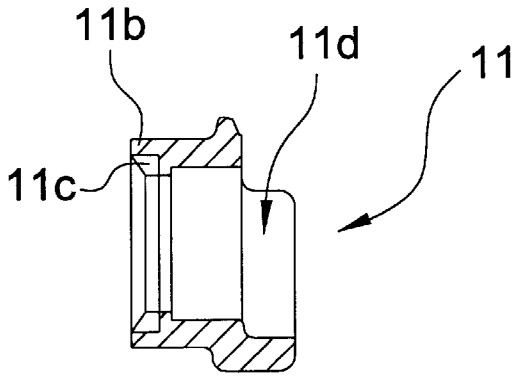
Figure 9C:
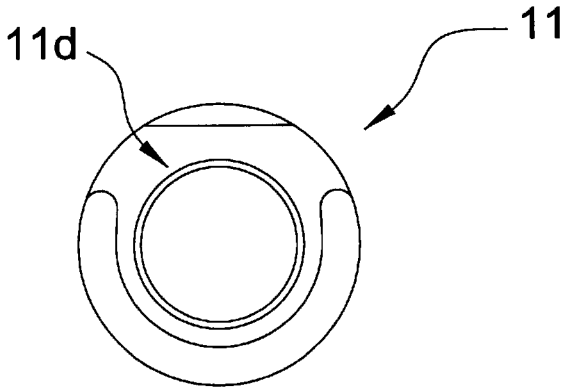
Figure 10:
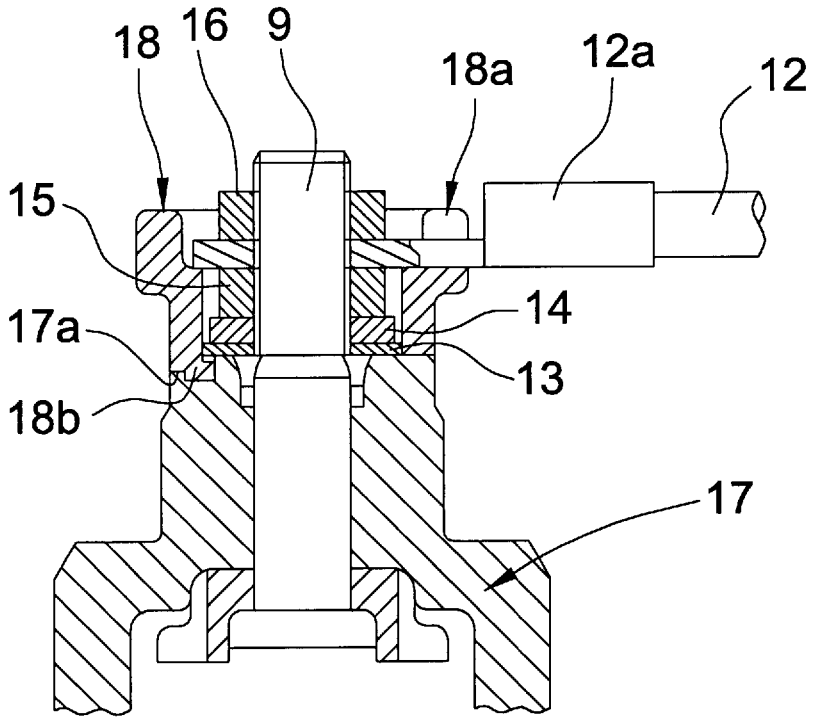
Fig. 10 PRIOR ART
FIGS. 10 is a side elevational view in cross-section of a major portion of a conventional terminal housing mounting structure.

Referring to FIGS. 1–9, an electromagnetic switch 1 is used as a starter switch and comprises a yoke 2, an end plate 3, an actuating coil 4, a plunger 5 having a movable iron core 5*a*, a movable contact point 7 mounted on an insulator 6 attached onto the movable iron core 5*a*, and a switch cover 8 that covers the end of the yoke 2. When current is conducted through the actuating coil 4, the movable contact point 7 on the iron core 5*a* is moved toward the switch cover 8 in the same manner as known in the art.

The switch cover 8 is formed of rigid insulating material such as phenolic resin or nylon mixed with glass wool and it is shaped into an integral, closed-end cylindrical form. The bottom portion of the switch cover 8, looking toward the movable contact point 7, has two through-holes 8*a*, 8*b* appropriately spaced apart from one another for allowing a battery side terminal bolt 9 connected to a battery (not shown) and a motor side terminal bolt 10 connected to a motor (not shown) to be respectively passed therethrough. Heads 9*a*, 10*a* of the respective terminal bolts 9, 10 are aligned with the longitudinal direction of the axis of the plunger 5 inside the switch cover 8, with their end portions projecting out of the switch cover 8. The through-holes 8*a*, 8*b* extend through the switch cover 8 and a terminal housing 11 is attached to the end portion 8*c* of the switch cover 8.

The terminal housing 11 is generally cylindrical and its bottom portion 11*a* abuts the end portion 8*c* of the switch cover 8. A cylindrical end portion 11*a* of the terminal housing (except for an outer-diameter end portion 11*b*) and a cylindrical end portion 8*c* of the switch cover (except for an inner-diameter end portion 8*d*) are respectively provided with eighteen (18) sawteeth 11*c* and 8*e* circumferentially disposed therearound at equal angular increments of 20 degrees. The terminal housing 11 can thus be angularly displaced with respect to the switch cover 8, in increments of 20 degrees at eighteen (18) different angular orientations. Thus, the angular displacement of the terminal housing 11 with respect to the switch cover 8 can be finely adjusted. These sawteeth 11*c*, 8*e* are engageable with each other so that the terminal housing 11 is prevented from moving angularly (in a connected state) with respect to the switch cover 8.

The terminal housing 11 has in its cylindrical structure a side cutout portion 11*d* that works as an alignment groove. The alignment groove 11*d* receives, in a fixed alignment, a lug plate 12*a* integrally attached to the conductor cable 12 that connects the terminal bolt 9 to the battery (not shown). The projection orientation of the lug plate 12*a* from the electromagnetic switch 1 is determined in view of the mounting position of the battery. The projection orientation of the lug plate 12*a* is set by angularly displacing the terminal housing with respect to the switch cover 8 so that the lug plate 12*a* and the alignment groove 11*d* are oriented in a desired direction.

A cylindrical socket of the terminal housing 11 is sized to accommodate a flat washer 13 and a spring washer 14 that are fitted around a threaded portion of the terminal bolt 9. A nut 15 is tightened around the terminal bolt 9 to secure the washers 13, 14 and the terminal housing 11 against the switch cover 8. Furthermore, a nut 16 is tightened to secure the lug plate 12*a* against the nut 15. A cylindrical end portion 11*a* of the terminal housing 11 is designed to mate with the inner-diameter end portion 8*d* of the switch cover 8 tightly or with a slight clearance therebetween and a tightening force by the nut 15 is received by the inner-diameter end portion 8*d* of the switch cover. The cylindrical end portion 11*a* of the terminal housing 11 is more inwardly radially projected than the inner cylindrical wall of the terminal housing 11, and thus prevents the terminal housing 11 from slipping off. With the terminal housing 11 mounted to the switch cover 8, an outer side surface of the terminal housing 11 is flush with an outer side surface of the switch cover 8 and the outer-diameter end portion 11*b* of the terminal housing 11 abuts the outer ring step of the cylindrical end portion 8*c*.

In the above embodiment of the present invention, the electromagnetic switch 1 is connected to the battery by mounting the terminal housing 11 to the switch cover 8, and by connecting the conductor cable 12 to the terminal bolt 9 projected out of the cylindrical socket of the terminal housing. In this manner of mounting, the terminal housing 11 is oriented with respect to the switch cover 8 by allowing the sawteeth 11*c* formed on the cylindrical end portion 11a to be engaged with the sawteeth 8*e* formed on the switch cover 8. According to this embodiment of the present invention, the terminal housing 11 is angularly displaced with respect to the switch cover 8 in increments of 20 degrees and, thus, the orientation of the alignment groove 11*d* that determines the projection orientation of the lug plate 12*a* connected to the conductor cable 12 can be adjusted. In contrast to the prior art model-specific terminal housing dedicated to a single model only, the switch cover 8 and the terminal housing 11 find use in a number of models and, thus, make a multi-model component.

Because the terminal housing 11 and the switch cover 8 have on their mating portions, sawteeth 11*c*, 8*e*, respectively, mounting of the terminal housing 11 is easily performed while adjusting the orientation of the alignment groove 11*d*.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A terminal housing mounting structure for an electromagnetic switch, comprising:

a switch cover;

a cylindrical terminal housing mounted to the switch cover in a manner that the bottom surface of the terminal housing is in contact with the switch cover;

a terminal bolt that passes through the switch cover and extends into the terminal housing; and a lug plate mounted to the terminal housing in a manner that prevents the lug plate from rotating relative to the terminal housing, wherein mating ends of the terminal housing and the switch cover have projecting teeth disposed equiangularly around the circumference of the terminal housing and the switch cover so that the mating ends of the terminal housing and the switch cover can be engaged and an orientation of the terminal housing with respect to the switch cover is rotatably displaceable in increments equal to the number of teeth on the respective mating ends of the terminal housing and the switch cover.

2. A terminal housing mounting structure for an electromagnetic switch according to claim 1, wherein said projecting teeth are sawteeth.

3. A terminal housing mounting structure for an electromagnetic switch according to claim 1, wherein the projecting teeth are spaced apart from one another at 20 degree increments.

4. A terminal housing mounting structure adapted for use with an electromagnetic switch, a lug plate being releaseably connectable to the terminal housing mounting structure, comprising:

a switch cover member having a switch cover hole extending longitudinally therethrough and a switch cover toothed end portion extending about the switch cover hole, wherein a plurality of switch cover teeth are disposed equiangularly around the switch cover toothed end portion;

a terminal housing member having a terminal housing hole extending longitudinally therethrough and a terminal housing toothed end portion extending about the terminal housing hole and having a plurality of terminal housing teeth disposed around the terminal housing toothed end portion for mateable engagement with the plurality of switch cover teeth; and wherein a lug plate is attachable to the terminal housing member at a fixed angular orientation with respect to the terminal housing member, and wherein the terminal housing toothed end portion is mateably engagable with the switch cover toothed end portion at a plurality of angular orientations with respect to the switch cover such that the lug plate can project at a plurality of angular orientations relative to the switch cover.

5. A terminal housing mounting structure according to claim 4, wherein said terminal housing includes an alignment groove sized and adapted to receive the lug plate.

6. A terminal housing mounting structure according to claim 4, wherein the plurality of switch cover teeth and the plurality of terminal housing teeth are arranged radially around the switch cover hole and terminal housing hole, respectively.

7. A terminal housing mounting structure according to claim 6, wherein the plurality of switch cover teeth and the plurality of terminal housing teeth face a longitudinal direction of the terminal housing hole.

8. A terminal housing mounting structure according to claim 6, wherein the plurality of switch cover teeth and the plurality of terminal housing teeth are each angularly spaced from an adjacent tooth by 20 degrees.

9. A terminal housing mounting structure according to claim 6, wherein each of the pluralities of the switch cover and terminal housing teeth extends circumferentially about respective ones of the switch cover toothed end portion and the terminal housing toothed end portion.

10. A terminal housing mounting structure adapted for use with an electromagnetic switch and a lug plate releaseably connectable to the terminal housing mounting structure, comprising:

a switch cover member having a first switch cover end sized and adapted to abut the electromagnetic switch;

a terminal housing member having a first terminal housing end sized and adapted to receive the lug plate; and means for connecting said switch cover member and said terminal housing member between the electromagnetic switch and the lug plate in a manner so that said terminal housing member can rotate relative to said switch cover member whereby said terminal housing member can be disposed in a select one of a plurality of angular orientations relative to the switch cover member before the lug plate is releaseably connected to the terminal housing mounting structure, wherein said terminal housing member is disposable at a plurality of predefined angular orientations relative to the switch cover.

11. A terminal housing mounting structure according to claim 1, wherein said terminal housing member can be disposed in 20 increments about said switch cover member.

12. A terminal housing mounting structure according to claim 1, further comprising engagement means associated with and between said switch cover member and said terminal housing member to secure said terminal housing member in said select one of the plurality of angular orientations when the lug plate is releasably connected to the terminal housing structure.

* * * * *

UNITED STATES PATENT AND TRADEMARK OFFICE

CERTIFICATE OF CORRECTION

PATENT NO. : 5,812,041
DATED : September 22, 1998
INVENTOR(S) : Katsuhiko ISHIKAWA et al.

It is certified that error appears in the above-identified patent and that said Letters Patent is hereby corrected as shown below:

Please change:

[73] Assignee: Mitsuba Electric Manufacturing Co., Ltd., Kiryu, Japan to:

[73] Assignee: Mitsuba Corporation, Kiryu, Japan

Signed and Sealed this

Eighth Day of August, 2000

*Attest:*

*Attesting Officer*

Q. TODD DICKINSON

*Director of Patents and Trademarks*